United States Patent [19]

Thurlo

[11] 4,319,558

[45] Mar. 16, 1982

[54] FIREPLACE HEATER

[76] Inventor: Carl C. Thurlo, P.O. Box 386, Kingston, Okla. 73439

[21] Appl. No.: 134,487

[22] Filed: Mar. 27, 1980

[51] Int. Cl.[3] ..... F24B 7/00

[52] U.S. Cl. ..... 126/121; 126/131; 126/139; 126/120

[58] Field of Search ..... 126/121, 120, 129, 77, 126/131, 135, 138, 139, 99 A, 201, 202, 288, 290, 197, 192; 237/51, 52

[56] References Cited

U.S. PATENT DOCUMENTS

| | | | |
|---|---|---|---|
| 1,307,483 | 6/1919 | Coleman | 110/173 R |
| 1,365,912 | 1/1921 | Greene | 126/121 |
| 1,858,967 | 5/1932 | Pettiegrew | 126/139 |
| 3,027,217 | 3/1962 | Dutcher | 126/190 X |
| 3,789,825 | 2/1974 | Reiner | 126/202 X |
| 4,068,650 | 1/1978 | Nelson | 126/121 |
| 4,114,590 | 9/1978 | Frahm | 237/51 X |
| 4,147,153 | 4/1979 | Buckner | 126/63 |

*Primary Examiner*—Larry Jones
*Attorney, Agent, or Firm*—Wendell Coffee

[57] ABSTRACT

A metal front plate with a heat resistant seal around its edge forms an airtight cover over an existing fireplace face. Metal or glass doors in the plate allow logs to be placed in the fireplace. Primary air is regulated by dampers in the front plate on the doors. A fan housed in a grated housing outside the front plate circulates secondary air through a heat exchange tube system and out an orifice just above the doors. The front plate is clamped to the fireplace lintel and the tubes are raised by a leveling screw attached to the rear of the heat exchange tubes, drawing the bottom of the front plate firmly against the bottom of the fireplace front.

5 Claims, 8 Drawing Figures

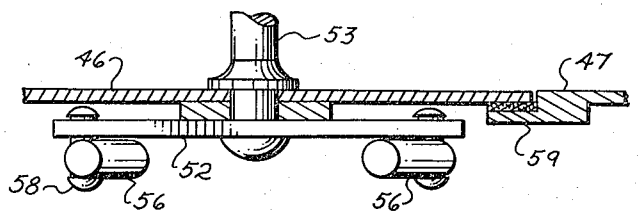
Fig. 7
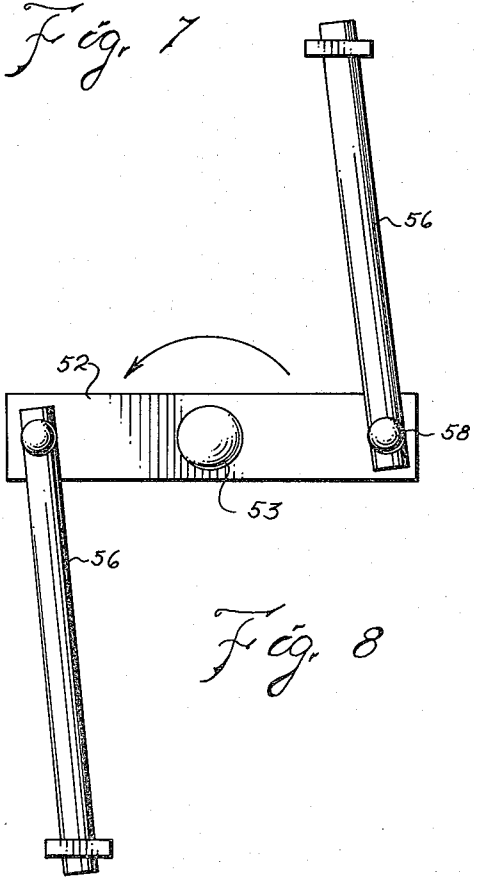
Fig. 8
Fig. 2
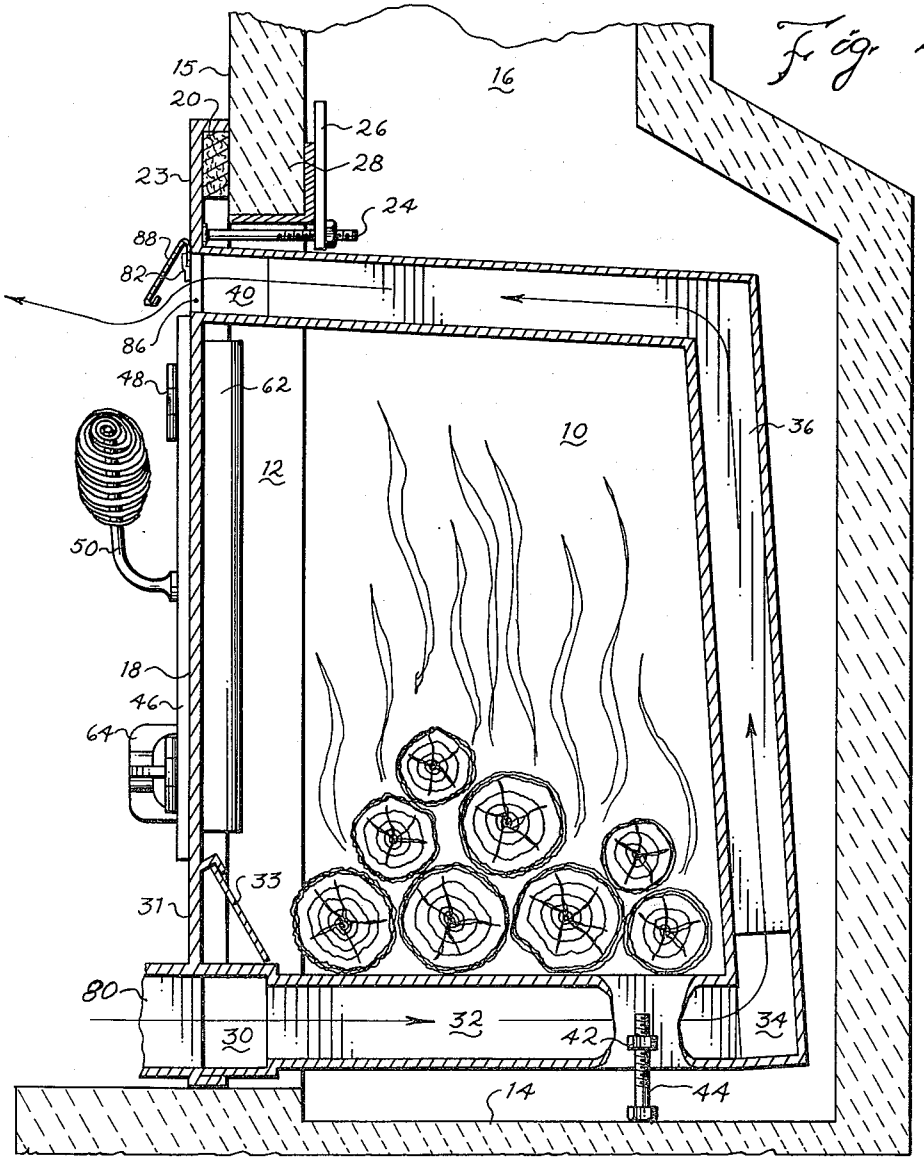

FIREPLACE HEATER

CROSS REFERENCE TO RELATED APPLICATIONS

None. However, applicant filed Disclosure Document No. 084,990 on Oct. 15, 1979, which document concerns this application; therefore, by separate letter, it is respectfully requested that the document be retained and acknowledgement thereof made by the Examiner. (MPEP 1706)

BACKGROUND OF THE INVENTION (1) Field of the Invention

This invention relates to a fireplace heating system and more particularly to a forced air system to be inserted into an existing fireplace.

(2) Description of the Prior Art

As used herein the term "fireplace" refers to a structure made of stone, brick or similar materials for the purpose of burning wood or other combustibles. Such structure usually includes a front, front opening, a hearth, a lintel in the top of the opening and a flue or chimney to expel products of combustion.

The heating of a home or other building by the use of a wood burning fireplace requires a large amount of firewood. Though firewood is a renewable resource, the demand for firewood required may far exceed the available supply.

Before this application was filed, applicant caused a search to be made in the United States Patent and Trademark Office at which time the following patents were found:

| | |
|---|---|
| PELLEGRINO | 3,452,737 |
| ABSHEAR | 3,880,141 |
| KAMPF | 3,938,496 |
| MARTENSON | 4,015,581 |
| HENRIQUES | 4,026,264 |
| NELSON | 4,068,650 |
| STITES | 4,091,794 |
| BERGSTROM | 4,129,113 |
| MARTENSON | 4,166,444 |

ABSHEAR discloses a brace for retaining a heat exchanger in the proper position in a fireplace. The others disclose various wood burning fireplace furnace constructions with forced air circulation.

SUMMARY OF THE INVENTION (1) New and Different Function

I have invented a novel way both creating an airtight cover over the face of a wood burning fireplace and using this cover to regulate the amount of primary air permitted into the combustion process. By regulating the air intake the temperature of the fire can be regulated. This prevents excess heat from escaping through the chimney and more efficiently makes use of the fuel burned.

With my invention the fireplace is sealed off from an unlimited supply of air for combustion by clamping to the fireplace lintel the top of a metal front plate having a heat resistant seal around its edge. Heat exchanger tubes mounted rigidly on the plate and extending into the hearth are then raised by use of a leveling screw. This causes the front plate's bottom to be pulled firmly against the fireplace face, sealing out air.

The combustion air supply is then regulated by one or more threaded, adjustable dampers mounted in the front plate. This regulation maintains efficient combustion and conserves energy.

A fan circulates secondary air from the room to be heated, through the heat exchange tubes surrounding the fire, and back to the room. The fan is housed outside the sealed front plate. The room air to be heated travels from the fan through a duct penetrating the sealed front plate through an orifice and in this way reaches the heat exchange tubes. After the room air is heated in the tubes it exits through another orifice in the sealed front plate. One or more doors, made of metal, glass or other materials in the front plate allows the logs or other fuel to be placed inside the fireplace. The doors also have heat resistant seals to make the system airtight.

Heat shields are placed behind the doors to prevent the doors from becoming excessively hot. Also, a heat shield is placed between the bottom of the doors and the inlet air header immediately below the doors to prevent the front plate in this particular area from overheating.

Thus, it may be seen that the total function of my invention far exceeds the sum of the functions of the individual fan, front plates, heat exchange tubes, clamps, dampers, leveling screws, etc.

(2) Objects of this Invention

An object of this invention is to heat a building with a modified fireplace.

Further objects are to achieve the above with a device that is sturdy, compact, durable, simple, safe, efficient, versatile, ecologically compatible, energy conserving, and reliable, yet inexpensive and easy to manufacture, install, adjust, operate and maintain.

Other objects are to achieve the above with a method that is versatile, ecologically compatible, energy conserving, rapid, efficient, and inexpensive, and does not require highly skilled people to install, adjust, operate, and maintain.

The specific nature of the invention, as well as other objects, uses, and advantages thereof, will clearly appear from the following description and from the accompanying drawing, the different views of which are not scale drawings.

BRIEF DESCRIPTION OF THE DRAWINGS

FIG. 2 is a side sectional view of the unit in the fireplace taken about on line 2—2 of FIG. 4 with parts broken away for clarity.

FIG. 7 is a plan view of the door latching device taken on line 7—7 of FIG. 4.

FIG. 8 is a rear elevational view of the door latching device with the heat shield removed for clarity.

DESCRIPTION OF THE PREFERRED EMBODIMENT

Figure 3:
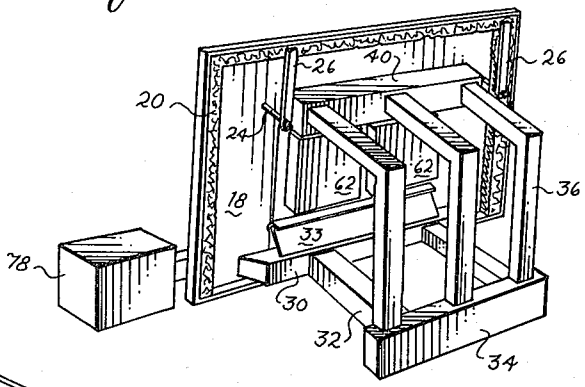
FIG. 3 is a perspective representation showing the rear of the unit removed from the fireplace.
Figure 6:
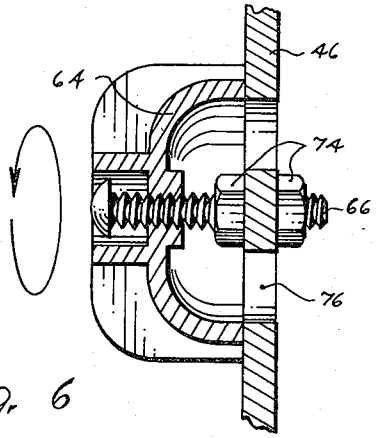
FIG. 6 is an enlarged side sectional view of one of the air dampers similar to FIG. 5.
Figure 1:
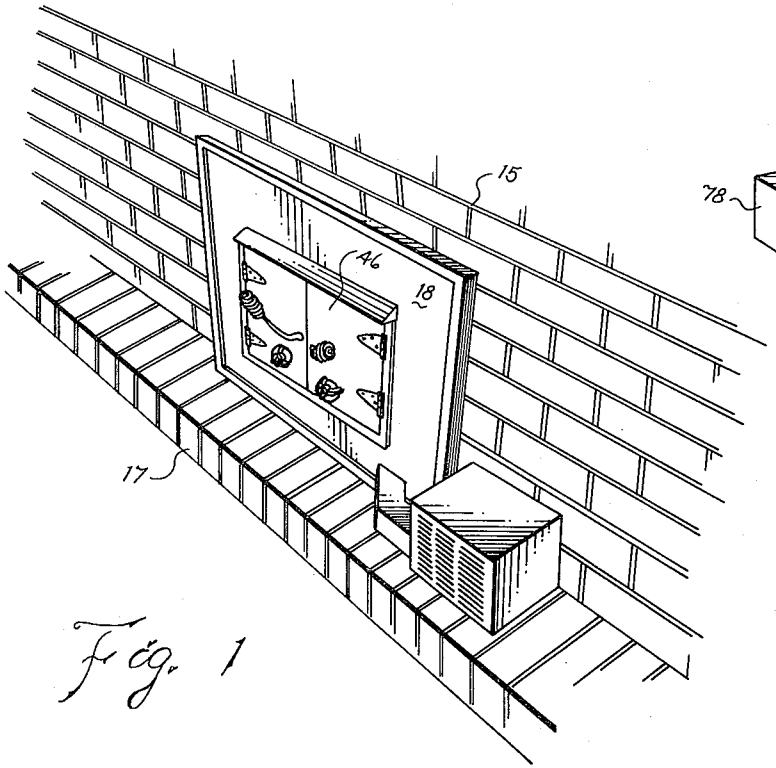
FIG. 1 is a perspective representation showing invention installed in a fireplace.

Referring to FIGS. 1, 2 and 3, fireplace 10 is shown having front opening 12 in decorative front 15. Hearth 14 extending into the room as hearth extension 17, forms the floor of fireplace 10. Lintel 28 forms the top of front opening 12 in decorative front 15. Chimney 16 allows exhaust gases to escape from the fireplace 10.

Those having familiarity in the art will recognize that the above description is a generic description of a fireplace.

Metal front plate 18 is placed over front opening 12. The front plate 18 is larger than the opening 12. Heat resistant seal 20 is placed between the back of the plate 18 and the front 15 to prevent air from entering the fireplace. Two bolts 24 are attached as by welding to the back of the front plate 18 near the top 23 thereof. One bolt 24 is on each side. Straps 26 extend over each bolt 24 and is held securely in place by nut 27. Referring particularly to FIG. 2 it may be seen that wen the nuts 27 are drawn down tightly it will press the top 23 of the plate 18 securely the front 15 holding the seal 20 between the front 15 and the plate 18. Thus, it may be seen that the bolts 24 and straps 26 form two clamp means 22 to hold the top of the plate against the front of the fireplace.

A bottom header 30 is rigidly attached to the back of plate 18 at the bottom 31 thereof. Two heat exchange tubes 32 extend horizontally into fireplace 10 to back header 34. Three heat exchange tubes 36 extend upward in the back of fireplace 10 from back header 34. The tubes 36 angle forward slightly until they extend horizontally toward the front 15. The three heat exchange tubes 36 are "L" shaped and extend to top header 40 which is rigidly attached to plate 18 at the top 23 thereof.

The tubes 32 fluidly connect the headers 30 and 34 while the tubes 36 fluidly connect the headers 34 and 40. Therefore, air forced into header 30 will pass through the tubes 32 to the header 34 then through tubes 36 to the header 40 and on out by top orifices 86 in the top 23 of the plate 18.

As may be seen the tubes 32 and 36 are rectangular or square in cross section. The tubes 32 form a grate for a wood fire and logs may be placed directly on them. Embers heat shield 33 is mounted on front plate 18 just below doors 46 and 47 and extending down to back of bottom header 32, sloping in the direction of the fireplace to protect the front plate 18 from hot embers and radiation within the fireplace.

A nut 42 is welded to the outside walls of each of the heat exchange tubes 32 near the back header 34. A leveling screw 44 is threaded through each of the nuts 42. By lowering leveling screw 44 the two heat exchange tubes 32 are raised and the bottom of the plate 18 is pulled firmly against the bottom of front 15. This compresses the seal 20 making the system airtight.

Figure 5:
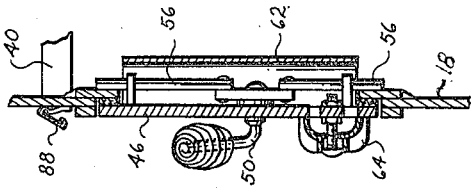
FIG. 5 is a side sectional view of the door of the unit taken about on line 5—5 of FIG. 4.
Figure 4:
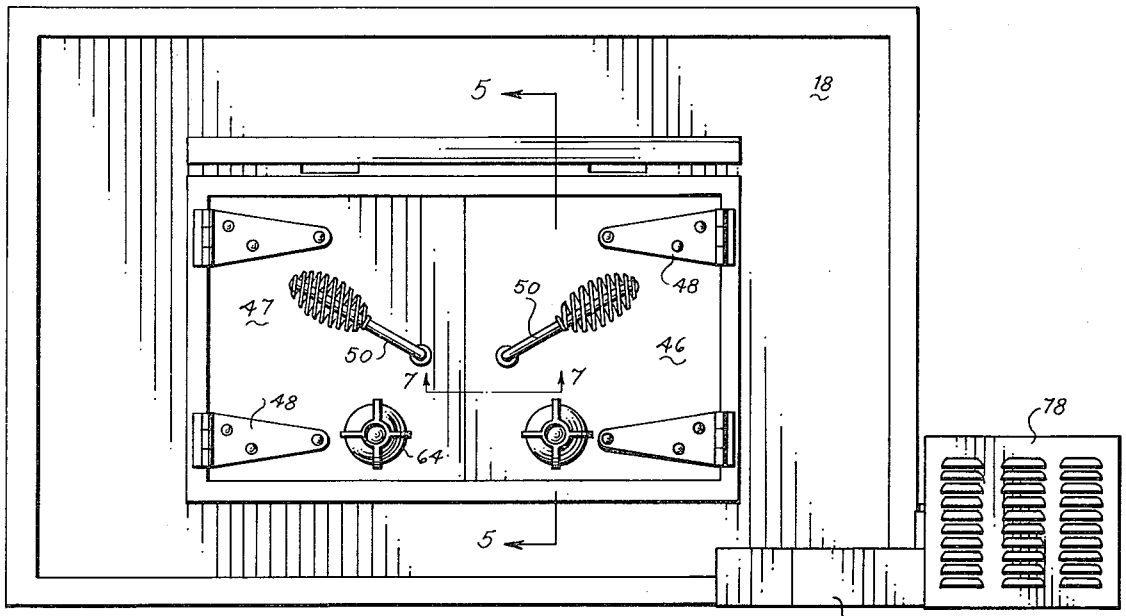
FIG. 4 is a front view of the unit.

Doors 46 and 47 are hung to the plate 18 by hinges 48. Handles 50 are mounted on the doors 46 and 47. Logs are placed inside fireplace 10 through doors 46 and 47. The door handle 50 on door 46 is connected to the middle of latch plate 52 by bolts 53 in such a manner the latch plate 52 rotates with the handle. Rods 56 are attached to each end of latch plate 52 by rivets 58. The rods 56 extend vertically behind door 46. When the door 46 is in the closed position rods 56 extend past the top and bottom edges of door 46 to hold door 46 firmly against the back of the front plate 18 (FIG. 5). Door 46 in turn holds door 47 firmly against front plate 18 by pressing against door lip 59 affixed to the inside of door 47. Heat resistant seal 60 is around the back edge of the doors. Door heat shields 62 are placed over back of doors 46 and 47 to protect the doors 46 and 47 and latch configruation from the radiant heat within the fireplace.

Dampers 64 are mounted on plate 18 by being mounted on the doors 46 and 47. Screws 66 are attached to the doors 46 and 47 over air inlet 76. The screws 66 are securely attached to the doors by nuts 74, one on each side. Each of the dampers 64 are threaded onto the screws 66. By rotating the dampers 64 the quantity of air permitted into the fireplace 10 is regulated.

A circulating fan 76 within grated housing 78 pulls secondary room air into the bottom header 30. The secondary air passes from housing 78 to bottom header 30 through duct 82. Air circulates through the heat exchange system in direction of the arrows in FIG. 2. Heated air exits heat exchange system through top orifices 86 above doors 46 and 47. Top orifice 86 is covered by orifice shield 88 to give a pleasant appearance. The shield 88 is attached by clips 82.

The embodiment shown and described above is only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

As an aid to correlating the terms of the claims to the exemplary drawings, the following catalog of elements is provided:

| | |
|---|---|
| 10 fireplace | 44 leveling screw |
| 12 front opening | 46 door |
| 14 hearth | 47 door |
| 15 front | 48 hinges |
| 16 chimmey | 50 handles |
| 17 hearth extension | 52 latch plate |
| 18 front plate | 53 bolt |
| 20 heat resistant seal | 56 latch rods |
| 22 clamp means | 58 rivets |
| 23 top | 59 door lip |
| 24 bolt | 60 heat resistant seal |
| 26 strap | 62 door heat shields |
| 27 nut | 64 dampers |
| 28 lintel | 66 damper screws |
| 30 bottom header | 70 damper orifice |
| 31 bottom | 74 damper nuts |
| 32 heat exchange tubes | 76 air inlet |
| 33 embers heat shield | 78 grated housing |
| 34 back header | 80 duct |
| 36 heat exchange tubes | 82 clips |
| 40 top header | 86 top orifices |
| 42 nut | 88 top orifice shield |

SUBJECT MATTER CLAIMED FOR PROTECTION

I claim as my invention:

1. A heater adapted to be inserted into a fireplace having a. a front, b. a front opening in the front, c. a lintel over the opening, and d. a hearth below the opening, wherein the improved heater comprises:

e. a front plate having a top and bottom, f. lintel clamp means on the top of the front plate for clamping same to the fireplace lintel, g. heat exchange tubes rigidly attached to the front plate and adapted to extend into a fireplace, h. leveling screw means on the tubes spaced away from the front plate for raising the tubes and forcing the bottom of the front plate against the front of the fireplace, i. heat resistant seal means between the front plate and fireplace front for keeping air from leaking into the fireplace, j. at least one door hinged to the front plate for adding fuel to the fireplace, k. heat resistant seal means between the door and front plate for keeping air from leaking into the fireplace, l. damper means located at the front of the fireplace for permitting a controlled amount of air to enter the fireplace, m. a bottom header attached to the back bottom of the front plate, n. two tubes fluidly connected to the bottom header extending to a rear header, o. three tubes extending from the rear header to a top header, thereby p. forming an air passage way from the bottom header to the top header, q. said tubes forming a rigid structure, r. orifices through the top of the front plate forming an air outlet from the top header through the front plate, s. a shield attached to the front plate extending over the orifices, t. an embers heat shield attached to the back of the front plate below the doors and extending downward over the bottom header to shield the front plate from hot embers and radiation within the fireplace, and u. door heat shields on back of the doors to shield the doors from radiant heat within the fireplace.

2. The invention as defined in limitations a. through u. of claim 1 further comprising:

v. there being two doors which are hinged to the front plate, w. one of said doors having a lip on the back side thereof, x. said other door fitting against said lip so that the door with the lip thereon is held closed by the door which fits over it, y. a latch upon the door which fits over the lip, z. said latch including a handle, aa. said handle having a bolt thereon which extends through the door, bb. a latch plate attached to the handle bolt on the back side of the door, cc. latch rods riveted to said latch plate, dd. one of the latch rods extending behind the front plate above the door and the other latch rod extending behind the front plate below the door so that when the latch rods are extended the door is latched in the closed position.

3. The invention as defined in limitations a. through dd. of claim 2 further comprising:

ee. a grated fan housing having an outlet, ff. the outlet of the fan housing connected to the bottom header, gg. an orifice in the top of the front plate connected to the top header, hh. so that air is circulated from the fan housing through the tubes and out the orifices.

4. The invention as defined in limitations a. through hh. of claim 3 wherein said leveling screw means includes:

ii. a nut welded to the heat exchange tubes, jj. a bolt threaded through said nut and extending down to bear against the hearth.

5. A heater adapted to be inserted into a fireplace having a. a front, b. a front opening in the front, c. a lintel over the opening, and d. a hearth below the opening, wherein the improved heater comprises:

e. a front plate having a top and bottom, f. two bolts extending back of the front plate at the top thereof, g. two straps each with a hole through it, h. one of said straps over each of the bolts, i. a nut behind each strap on the bolt, j. said strap extending behind the lintel, thus forming k. a lintel clamp means on the top of the front plate for clamping same to the fireplace lintel, l. there being two doors which are hinged to the front plate, m. one of said doors having a lip on the back side thereof, n. said other door fitted against said lip so that the door with lip thereon is held closed by the door that fits over it, o. a latch on the door which fits over the lip, p. said latch including a handle, q. said handle having a bolt thereon which extends through the door, r. a latch plate attached to the handle bolt on the back side of the door, s. latch rods riveted to said latch plate, t. one of the latch rods extending behind the front plate above the door and the other latch rod extending behind the front plate below the doors so that when the latch rods are extended the door is latched in the closed position, u. a bottom header attached to the back bottom of the front plate, v. two tubes fluidly connected to the bottom header extending to a rear header, w. three tubes extendng from the rear header to a top header, x. said top header attached to the top back of the front plate, y. thereby forming an air passage way from the bottom header to the top header, z. said tubes forming a rigid structure, aa. orifices through the top of the front plate forming an air outlet in the top header to the front plate, bb. an orifice shield attached to the front plate extending over the orifices, cc. a grated fan housing on the front side of the plate, dd. a duct extending from the grated fan housing to the bottom header so that air may be forced from the grated fan housing through the tubes out through the orifices through the top of the front plate, ee. an embers heat shield attached to the back of the front plate below the doors and extending downward over the bottom header to shield the front plate from hot embers and radiation with the fireplace, and ff. door heat shields on the back of the doors to shield the doors from radiant heat within the fireplace, gg. two nuts, one welded to each of the two tubes fluidly connecting the bottom header and rear header, hh. bolt threaded to each nut and extending down to bear against the hearth, ii. said bolts forming a leveling screw means on the tube, jj. said nuts adjacent to said back header, kk. so that the tubes may be raised thus forcing the bottom front plate against the front of the fireplace, and ll. heat resistant shield means between the front plate of the fireplace front for keeping air from leaking into the fireplace.

* * * * *